United States Patent [19]

Flüeli et al.

[11] Patent Number: 4,739,940

[45] Date of Patent: Apr. 26, 1988

[54] METHOD AND APPARATUS OF FORMING AN OVERWOUND TRANSFER TAIL

[75] Inventors: Adolf Flüeli; Heinz Oswald; Kurt Schefer, all of Winterthur, Switzerland

[73] Assignee: Rieter Machine Works Limited, Winterthur, Switzerland

[21] Appl. No.: 926,227

[22] Filed: Nov. 3, 1986

Related U.S. Application Data

[62] Division of Ser. No. 723,981, Apr. 16, 1986, Pat. No. 4,641,793.

[51] Int. Cl.[4] ..... B65H 54/34
[52] U.S. Cl. ..... 242/18 PW
[58] Field of Search ..... 242/18 PW, 18 A, 43 R

[56] References Cited

U.S. PATENT DOCUMENTS 3,823,884 7/1974 Sartori ..... 242/18 PW
3,858,816 1/1975 Corbiere ..... 242/18 PW

*Primary Examiner*—Stanley N. Gilreath
*Attorney, Agent, or Firm*—Werner W. Kleeman

[57] ABSTRACT

The method of forming an overwound thread transfer tail entails moving a thread guide carrier which supports a thread guide in a first direction against an abutment and permitting the thread guide carrier to recoil and thereby cause a return movement of the thread guide after striking said abutment. The apparatus for performing the method comprises a thread guide and a movable member movable in a predetermined direction and connected to the thread guide. An abutment serves for limiting movement of said movable member in such predetermined direction, and structure is provided for moving the movable member against the abutment in a manner such as to cause recoil of the movable member.

4 Claims, 4 Drawing Sheets

10
12
14
16A
16B
18
20A
20B
22
26
28
30
32
34
36
38
40
42
44
45
46
48
100
101
102
104
106
108

Fig. 4A
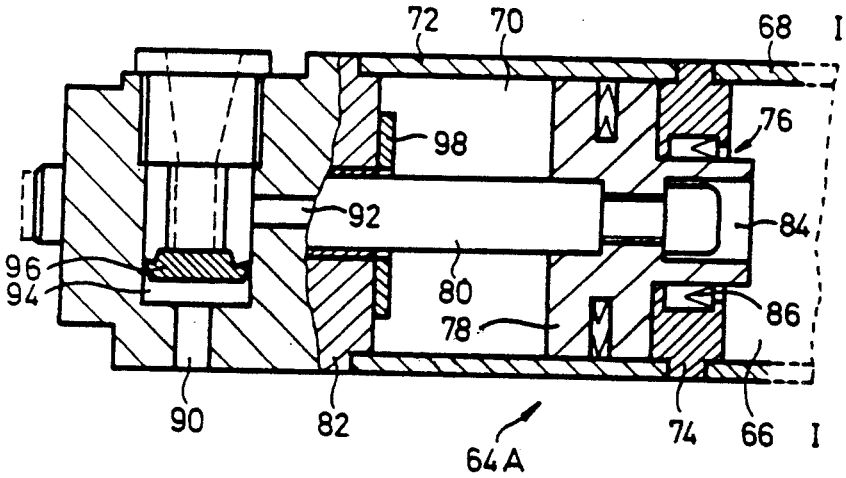
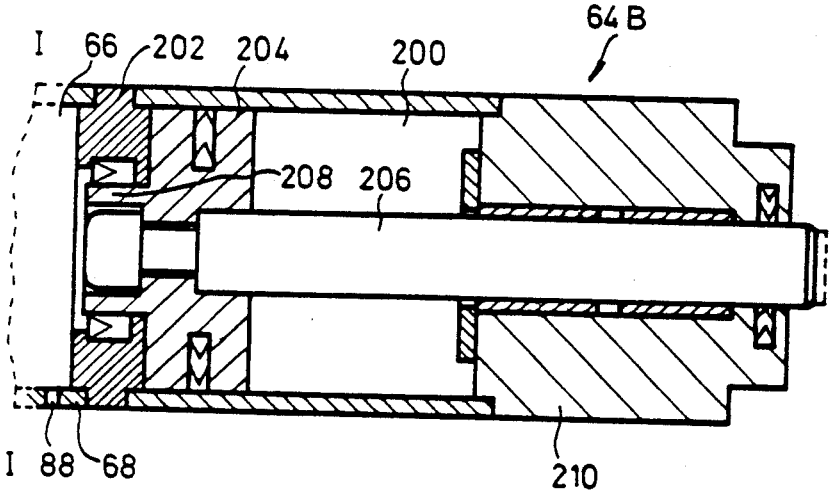
Fig. 4B

METHOD AND APPARATUS OF FORMING AN OVERWOUND TRANSFER TAIL

CROSS-REFERENCE TO RELATED APPLICATION

This application is a divisional of my commonly assigned copending application Ser. No. 06/723,981, filed Apr. 16, 1986, entitled: "THREAD WINDING MACHINE INCLUDING A PISTON AND CYLINDER UNIT, METHOD OF PERFORMING AUTOMATIC CHANGEOVER OF WINDING A THREAD, AND METHOD OF FORMING AN OVERWOUND TRANSFER TAIL", now U.S. Pat. No. 4,641,793 granted Feb. 10, 1987.

BACKGROUND OF THE INVENTION

The present invention broadly relates to filament winding and, more specifically, pertains to a new and improved system for catching and winding a thread to form a thread package on a bobbin tube.

The invention particularly relates to an improved thread winding machine including a piston and cylinder unit, to a method and apparatus for performing automatic changeover of winding of a thread, and to an apparatus for forming an overwound transfer tail or thread reserve.

The term "thread" refers particularly, but not exclusively, to threads of synthetic plastic filament in monofilamentary or multi-filamentary form. For reasons which will be apparent from the following description, the invention is designed particularly, but not exclusively, for use in winding machines for winding packages of relatively high denier (titer) thread, and especially for automatic, so-called wasteless, winders for this purpose.

Generally speaking, the automatic changeover apparatus and method of the present invention serve for the automatic changeover of winding of a thread from a completed package on an outgoing chuck to an empty bobbin on an incoming chuck.

The piston and cylinder unit of the thread winding machine of the present invention is of the type comprising a cylinder housing with first and second chambers, dividing or separating means between the first and second chambers, and a piston movable longitudinally in the first chamber.

The apparatus for forming an overwound thread transfer tail of the present invention is of the type comprising a thread guide and a movable member movable in a predetermined direction and connected to the thread guide.

The method of the present invention is for forming an overwound thread transfer tail.

Automatic winders for synthetic filament threads are now very well known in the relevant art, and will not be described herein in detail. One example of a so-called "revolver" machine of this type is described and illustrated in U.S. Pat. No. 4,298,171, granted Aug. 15, 1978, although many alternative designs for this kind of machine are also known.

An automatic winding machine operating on a different principle (different "machine geometry") is illustrated and described in the European Patent Application published under the Publication No. 73,930 and corresponding with U.S. applications Ser. No. 402,014, filed Aug. 25, 1982, now abandoned, Ser. No. 411,701, filed Aug. 26, 1982, now U.S. Pat. No. 4,497,450 and Ser. No. 411,908, filed Aug. 26, 1982, now U.S. Pat. No. 4,524,918. Still further machine designs have been proposed from time to time for automatic winding machines.

Common to all such designs is a plurality of chucks or spindles individually rotatable about their respective longitudinal chuck axes. Each chuck is adapted to receive one or more bobbin tubes and has means for securing received bobbin tubes to the chuck structure for rotation therewith about the chuck axis.

Thread is delivered to the winder or winding machine continuously. When a delivered thread has been wound into a completed package on one chuck, it is transferred to another chuck on which winding of a new package starts, the thread being severed between the two chucks.

Automatic winders are commonly used to wind threads of relatively heavy denier (titer), for example threads for industrial purposes (technical titer), tire cord, carpet yarn et cetera. With such strong yarns it is necessary to cut the thread between the two packages during a changeover. It is not sufficient to rely upon tearing of the thread between the two packages as in the case of relatively weak textile threads. It is therefore normal practice to provide thread catching and cutting devices incorporated in the structure of each chuck, e.g. as shown in U.S. Pat. No. 4,106,711, granted Aug. 15, 1978, or as described (but not illustrated) in U.S. Pat. No. 4,477,034, granted Oct. 16, 1984.

Where a thread-catching and cutting device is incorporated in the chuck structure, then it is normally recessed slightly below the outermost cylindrical surface of that chuck structure. This enables a bobbin tube or tubes to be passed over the thread catching and cutting device as they are moved onto and off the chuck by axial movement relative to the chuck. A problem then arises in that the thread must first of all be engaged with the recessed catching and cutting device and then must "climb" out of that device onto the neighboring bobbin tube in order to start formation of the desired package thereon.

Systems have already been proposed for operation during the changeover from a completed package to a new chuck, firstly to engage the thread with a guide surface on the new chuck and then to move the thread axially of the chuck into the catching and cutting device and then onto the adjacent bobbin tube. Such a system is shown, for example, in U.S. Pat. No. 3,920,193, granted Nov. 18, 1975. Although not referred to in that patent, it is also common practice to provide the axial end face of each bobbin tube with a notch which catches the thread as the latter is moved axially past the bobbin end face and which assists the thread to climb onto the bobbin tube.

Despite these precautions, it is still often found that the thread has difficulty climbing onto the tube, so that several thread windings are formed on the chuck structure itself beside the axial face of the tube before the thread finally succeeds in passing onto the bobbin outer surface. This is very disadvantageous for several reasons.

When the subsequent winding operation is completed, with a full package on the bobbin tube, the continuously delivered thread is transferred to another chuck and the chuck with the completed package is braked to a standstill. The thread catching device is usually arranged to release the thread end at this stage (e.g. as described in U.S. Pat. No. 4,106,711 referred to above), so that the completed package can be withdrawn from the chuck by passing back over the recessed catching device. In so doing, it also passes over the additional windings which have been formed on the chuck because of the failure of the thread to pass cleanly onto the bobbin tube at the start of the winding operation. These windings are now relatively loose, and they are drawn out into a long tail extending back between the bobbin tube and the chuck surface.

With heavy packages, and with some bad luck in maneuvering the package relative to the chuck, the thread tail can actually jam the bobbin tube relative to the chuck, causing considerable difficulty in removal of the package. Even where the package does not jam completely on the chuck, the drag exerted on the thread tends to loosen the transfer tail windings formed, for example as described in the previously mentioned U.S. Pat. No. 3,920,193, between the end of the bobbin tube and the actual package structure thereon. The lack of a secure and cleanly formed transfer tail winding can severely adversely affect the value of the whole package, even though the bulk of the thread material is contained in the package structure itself.

Furthermore, it may be necessary to clear the incorrectly formed windings from the chuck structure before the next winding operation can start, if such windings are not drawn off the chuck with the associated package. However, it is now common practice to provide relatively long chucks and to form a plurality of packages simultaneously on a single chuck from a corresponding plurality of continuously delivered threads. The chucks commonly extend cantilever-fashion from a headstock containing drive and support systems for the chucks. The machines are usually arranged at a very close spacing so that very little access-room is available around the chucks themselves. If, now, the incorrect windings are formed on the portion of the chuck structure adjacent the inboard bobbin tube, then severe difficulty is experienced in clearing such windings so as to prepare for the next winding operation.

Despite all precautions taken with systems previously available, it has been common to produce defective reserve windings or transfer tails due to the faults referred to above, and this represents a substantial economic loss due to the diminution in value of the complete packages associated therewith.

SUMMARY OF THE INVENTION

Therefore, with the foregoing in mind, it is a primary object of the present invention to provide a new and improved method and apparatus for catching and winding thread which do not exhibit the aforementioned drawbacks and shortcomings of the prior art constructions.

Another and more specific object of the present invention aims at providing a new and improved method and apparatus of the previously mentioned type for achieving a very substantial reduction in the production of defective packages from the above mentioned causes.

A further significant object concerns a method and apparatus for forming an overwound thread transfer tail in a highly efficient and reliable manner.

Yet a further significant object of the present invention aims at providing a new and improved apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present invention for performing automatic changeover is manifested by the features that it comprises a piston and cylinder unit and a thread guide connected to the piston of the piston and cylinder unit for movement in combination therewith.

A further aspect of the invention provides a piston and cylinder unit comprising a cylinder housing with first and second internal chambers, dividing or separating means between the chambers, a piston movable longitudinally of the first chamber, a piston extension extending longitudinally from the piston towards the second chamber, a port in the dividing means adapted to receive the extension when the piston is near the dividing or separating means, the piston extension being adapted to engage the dividing or separating means when received by the port to separate the chambers. The stroke of the piston in the first chamber is long enough to permit the extension to pass out of the port and be located wholly within the first chamber, thereby permitting fluid communication between the two chambers. The effective surface area of the extension, that is the area upon which pressure in the chambers is effective on the extension to produce longitudinal movement in use, is much smaller than the effective surface area of the piston and extension combination. Any pressure available in the second chamber will suddenly have a much greater effect upon the piston and extension combination as soon as the extension clears the port and permits fluid communication between the two chambers. A winding machine as defined is referred to hereinafter as "a winding machine of the type described".

The method of the present invention comprises the steps of moving a thread guide carrier which supports a thread guide in a first direction against an abutment and permitting the thread guide carrier to recoil and thereby cause a return movement of the thread guide after striking the abutment.

The basic effect of this speed variation has already been described in the previously mentioned U.S. Pat. No. 3,920,193. As described there, a higher axial speed of the thread will produce a higher angle between any given thread length and a cross section taken through the chuck and the bobbin tube. This effect has already been used to advantage as described in the previously mentioned U.S. Pat. No. 3,920,193 in order to improve the angle of the thread as it passes from the transfer tail windings into the main package structure. However, in that prior patent, the thread was moved through the catching device and onto the bobbin tube at a constant axial speed; this speed is limited by the angle of thread required to enable catching by the catching device. It is found that the problems outlined in the introduction to this specification can be substantially reduced by substantially increasing the angle of a thread relative to the chuck cross section during the climbing stage.

In principle, a device suitable for producing the speed differential has already been described with reference to FIGS. 4 to 7 of the previously mentioned U.S. Pat. No. 3,920,193. To enable use in the present invention, that device would simply have to be adapted to enable the speed change to occur immediately after catching of the thread instead of after the thread has climbed onto the bobbin tube as described in the prior patent specification. However, a second aspect or embodiment of this invention provides a modified operating system for the guide means referred to above, which operating system is substantially improved over that described in the previously mentioned U.S. Pat. No. 3,920,193, bearing in mind the now intended purpose.

BRIEF DESCRIPTION OF THE DRAWINGS

The invention will be better understood and objects other than those set forth above will become apparent when consideration is given to the following detailed description thereof. Such description makes reference to the annexed drawings, wherein:

FIGS. 4A and 4B illustrate respective longitudinal sections through a pneumatic piston and cylinder unit incorporated in the winder of FIG. 3.

DETAILED DESCRIPTION OF THE PREFERRED EMBODIMENTS

Describing now the drawings, it is to be understood that to simplify the showing thereof only enough of the structure of the thread winding machine has been illustrated therein as is needed for those skilled in the art to readily understand the underlying principles and concepts of the present invention.

Figures 1A, 1B:
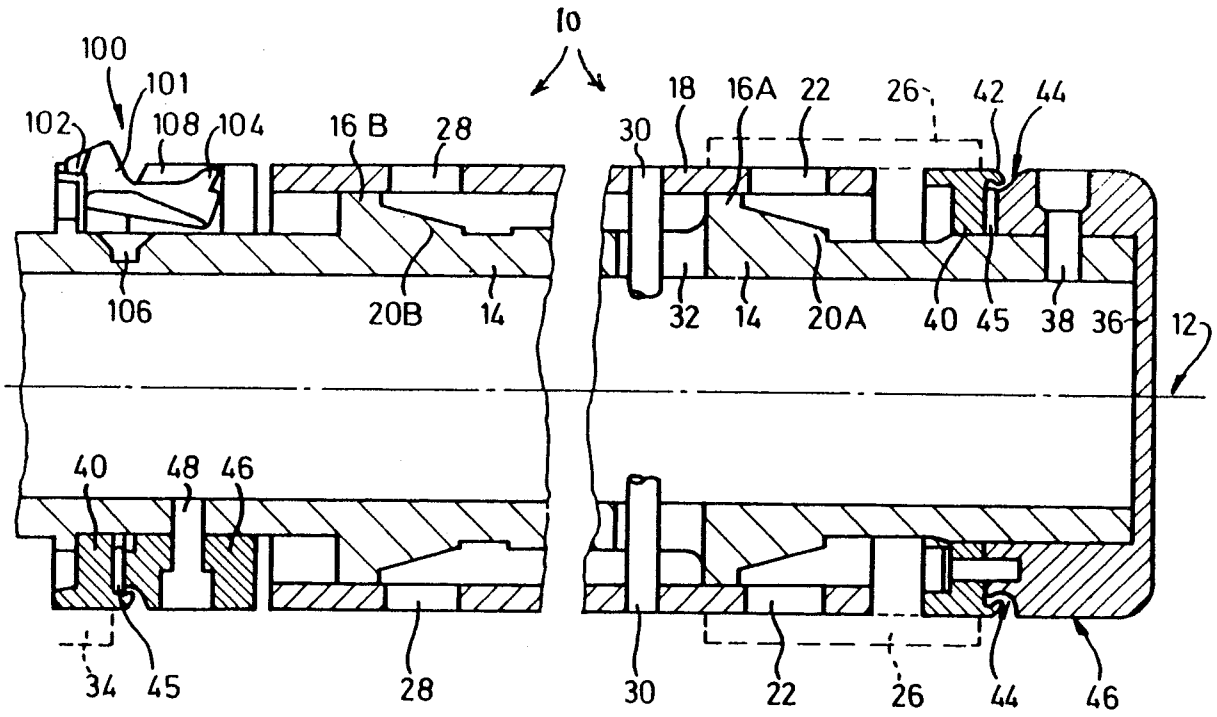
FIG. 1A is a longitudinal section through the outboard end of part of a chuck structure for use in an automatic winding machine.
FIG. 1B is a longitudinal section through the intermediate portion of part of a chuck structure for use in an automatic winding machine.

Turning attention now specifically to FIGS. 1A and 1B of the drawings, the apparatus illustrated therein by way of example and not limitation and employed to realize the methods as hereinbefore described will be seen to comprise a chuck 10 for a filament winding machine. This chuck 10 is mounted cantilever-fashion, projecting forwardly from a not particularly shown conventional headstock which would be disposed to the left of the chuck portion illustrated in FIG. 1B. Chuck 10 is mounted in the headstock so as to enable the chuck to rotate in use about its own longitudinal chuck axis 12.

FIG. 1A shows the outboard end of the chuck 10, whereas FIG. 1B shows an intermediate portion of the same chuck 10. As will be described below, the chuck 10 is adapted to enable winding of a plurality of threads simultaneously into a corresponding plurality of thread packages spaced axially along the chuck 10.

The main structural element of the chuck 10 is a longitudinally extending, tubular support 14. Within this hollow support 14 there are arranged not particularly shown conventional pneumatic operating devices for chuck elements which will be further described below. These pneumatic operating devices are conventional, and accordingly they have not been illustrated in the figures, and will not be described in any further detail.

The tubular support or hollow tube 14 has a plurality of outwardly projecting lands 16A, 16B which support a plurality of sleeves 18 concentric with the tube 14 and axially slidable thereon. The number of sleeves 18 corresponds to the number of packages to be formed on the chuck 10. For convenience of description, it will be assumed that only one such sleeve 18 is illustrated in FIGS. 1A and 1B; the outboard end of the sleeve 18 is seen in FIG. 1A and the inboard end in FIGS. 1A and 1B. The other sleeves 18 are the same as that actually illustrated in FIG. 1, and the associated elements (which will now be described) are also the same.

Adjacent each land 16A and 16B the tube 14 has an annular camming ring 20A and 20B, respectively. In its end portion near ring 20A, the sleeve 18 has a plurality of elongated slots 22, only two of which can be seen in FIG. 1A. Each slot 22 extends longitudinally of the sleeve 18 and the slots 22 are equiangularly spaced around the axis 12. Each slot 22 receives and retains in use a respective camming element which is conventional and has been omitted for clarity of illustration in FIGS. 1A and 1B. The radially inner portion of the camming element has a surface designed to ride on the camming ring 20A as sleeve 18 is moved axially to the left as viewed in FIG. 1A, thereby forcing the camming element radially outwardly relative to this sleeve. This enables the "head portions" (i.e. the radially outward portions) of the camming elements to project into and retain a bobbin tube 26 (dotted lines) which has been placed on the chuck 10 ready for a winding operation.

In its end portion near ring 20B, sleeve 18 has a second plurality of similar slots 28, only two of which can be seen in FIG. 1B, and similar camming elements are disposed in these slots 28 for cooperation with the ring 20B as sleeve 18 is moved axially in the chuck structure 10. Each bobbin tube 26 is therefore held by two rings of camming elements adjacent the inboard and outboard ends respectively of the bobbin tube.

Axial movement of sleeve 18 in the chuck structure 10 is caused by the pneumatically operating devices referred to above within the hollow tube 14. A connection pin 30 extends from these devices through a slot 32 in the tube 14 to engage with sleeve 18, so that movement of pin 30 axially of the chuck 10 causes corresponding axial movement of sleeve 18. As already referred to above, movement of sleeve 18 to the left as viewed in FIG. 1A causes the camming elements to be moved radially outwardly to engage and retain tube 26, and movement of sleeve 18 to the right as viewed in FIG. 1A will permit the head portions of the camming elements to retract within the circumference of sleeve 18, thereby releasing tube 26 (and a thread package carried thereon) for removal from the chuck 10.

By way of example, retention of the outboard bobbin tube 26 has been described in detail above. An end portion of the adjacent bobbin tube 34 is indicated in FIG. 1B. It will be understood that the retention of this bobbin tube 34 is effected in the same manner, and this statement applies to any other bobbin tubes carried by the chuck 10.

At its outboard end, chuck 10 is closed by a cap 36 secured to hollow tube 14 by screws 38. The inboard end of cap 36 cooperates with a ring element 40, mounted on the hollow tube 14, to form a thread catching and severing structure.

It is sufficient to mention here that ring element 40 has axially projecting teeth 42 (only one of which can be seen in FIG. 1A) and the inboard end of cap 36 is formed with a guide surface 44 for guiding a thread underneath the teeth 42. Under each tooth 42 there is a radially movable clamping pin 45 which moves outwardly under centrifugal force when chuck 10 is rotating at its normal operating speed to engage the underside of its respective tooth 42 and thereby form a clamp for a thread end severed on the tooth 42.

There is a respective thread catching and severing ring for each bobbin tube carried by the chuck 10 in use. The ring for bobbin tube 34 can be seen in FIG. 1B and this ring again comprises a ring element 40 identical to the element 40 in FIG. 1A. In each inboard ring, the counterpart to ring element 40 is provided by a second, annular ring element 46 secured to hollow tube 14 by screws 48. In FIG. 1B, the clamping pin 45 has been shown in its radially outward (operating) position, whereas in FIG. 1A the clamping pin 45 has been shown in its radially inward (release) position.

Explicit catching and severing structures have been described and illustrated by way of example only. Other structures could be substituted without difficulty. Alternative structures could also be devised. From the point of view of the present invention, the significant point is that these ring structures lie within the envelope of the chuck 10 itself, i.e., within the imaginary cylindrical surface containing the circumference of sleeve 18. Accordingly, the point at which each thread is clamped (in FIGS. 1A and 1B the point of contact of a clamping pin 45 with a tooth 42) lies radially inward of the outer cylindrical surface of the respective bobbin tube 26, 34 et cetera. on which the respective package is to be formed. The thread must therefore "climb" from the catching and severing structure onto the associated bobbin tube. If the thread fails to climb cleanly onto the bobbin tube 26, 34 and so forth within one revolution of the chuck following catching of the thread, then at least one winding will be formed on the periphery of ring element 40. As will be described later, one such winding is not a serious problem, but if the thread repeatedly fails to climb onto the associated bobbin tube, then an accumulation of windings will form on ring element 40 and this accumulation becomes more serious as more windings are added to it.

As will be described below, the present invention enables the thread to be moved relative to the chuck 10 and its associated bobbin tube 26 or 34 in a manner which at least substantially reduces the rate of occurrence of substantial accumulations of thread windings on ring elements 40. The means by which this is achieved will be first described broadly by reference to the diagrams in FIGS. 2A, 2B, 2C and 3.

FIG. 3A again shows the chuck 10, viewed this time in front elevation. Chuck 10 is assumed to be in driving relationship with a friction drive roller 50. Roller 50 is mounted in the not particularly shown conventional headstock already referred to above, and is rotatable about its own longitudinal axis 51 parallel to the chuck axis 12 (FIG. 1A). The arrangement is essentially as disclosed in the previously mentioned European Patent Application published under the Publication No. 73,930. Threads, such as thread 52 indicated in FIG. 3A, delivered to the winding machine pass first around friction roller 50 before being transferred to respective packages forming on chuck 10.

Threads 52 are wound around chuck 10 by reason of the rotation of the latter about its chuck axis 12, caused by its driving contact with friction driver or drive roller 50. In order to produce the required build for each package forming on chuck 10, each thread is contacted during a winding operation, upstream from the friction drive roller 50, by the thread guide element 54 of a conventional thread traverse mechanism 56. This arrangement is very well known in the art, and it will not be described in detail here.

During a changeover operation in which the thread leading to a completed package on an outgoing chuck is guided onto an incoming chuck in order to start forming a new package thereon, each thread is pushed out of contact with traverse mechanism 56 by a pneumatically operated piston and cylinder unit 58 just upstream from the traverse mechanism 56. The piston of the unit 58 pushes each thread into contact with a bar 60 disposed on the side of the thread path opposite the traverse mechanism 56. The threads are engaged in respective notches 62 (FIG. 3B). Bar 60 is reciprocatable axially of friction drive roller 50 and chuck 10 by means of a piston and cylinder unit diagrammatically indicated at 64 in FIG. 3A, one suitable embodiment of which will be described later in this specification in connection with FIGS. 4A and 4B.

The basic operation of thread guide bar 60 of such thread guide has already been disclosed in the previously mentioned U.S. Pat. No. 3,920,193. Thus, at completion of a winding operation on an outgoing chuck, thread guide bar 60 is first held stationary in a predetermined starting position and the threads are forced into the respective notches 62 by piston and cylinder unit 58. The threads therefore no longer traverse axially of their respective packages, but form an accumulation of windings at predetermined locations on the outer circumference of their respective packages. Taking the outboard thread 52 by way of example, the predetermined location is such that the length of thread extending between friction drive roller 50 and the outgoing package engages the cylindrical surface of the end cap 36 on incoming chuck 10. The inboard threads engage the cylindrical surfaces on their respective associated ring elements 46 (FIGS. 1A and 1B).

Bar 60 is now drawn axially of friction drive roller or roll 50 and chuck 10 from the above described starting position inboard towards the non-illustrated headstock. Each thread is therefore drawn to the left as viewed in FIGS. 1A and 1B from the cylindrical receiving surface on end cap 36 or ring element 46 onto the respective guide surface 44 (FIG. 1A), by means of which the thread is directed underneath the teeth 42 of the associated ring element 40 (FIGS. 1A and 1B). By this means, the thread is clamped and severed so that the threads are now each secured to the incoming chuck 10 and have been separated from the packages on the outgoing chuck (not illustrated).

Continued axial movement of the thread guide bar 60 in the same direction will draw the clamped thread onto the associated bobbin tube 26, 34 et cetera, whereafter thread reserve windings or transfer tails can be formed (for example as disclosed in U.S. Pat. No. 3,920,193) and the threads can eventually be returned to the traverse mechanism 56 to enable normal package winding to start. In the system disclosed in the previously mentioned U.S. Pat. No. 3,920,193, the speed of axial movement of thread guide bar 60 is maintained constant during catching of the thread and movement onto the associated bobbin tube. The speed of axial movement of this bar 60 during the catching phase must be maintained at a relatively low level, in order to enable a desired wrap of the thread in the catching and severing ring structure during the catching phase. It has now been discovered that the use of a relatively high speed of axial movement of the thread guide bar 60 during the thread climbing phase can significantly reduce the occurrence of undesired accumulations of windings on the ring elements 40. A desirable mode of movement of the thread during the changeover operation can be seen from FIG. 2B.

Figure 2C:
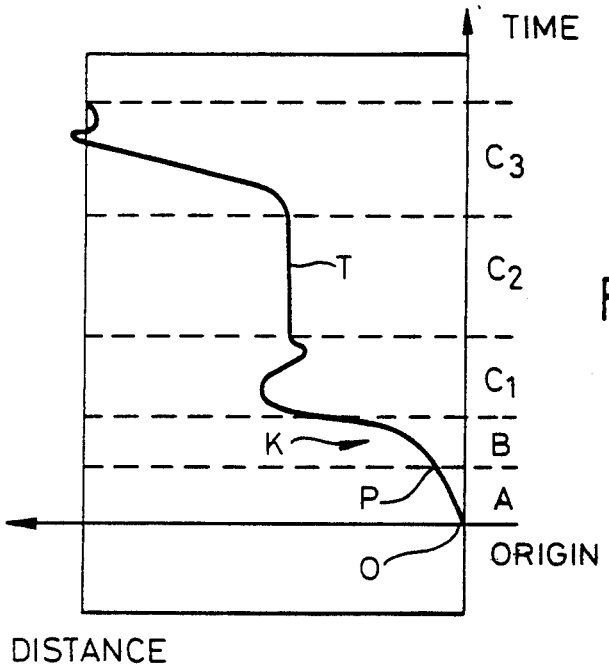
FIG. 2C is an oscilloscope trace representing movement of a thread guide axially of the chuck.
Figure 2A:
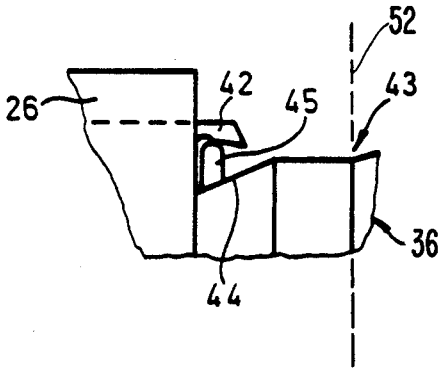
FIG. 2A is a diagram showing the outline of part of a chuck structure in accordance with FIG. 1.

FIG. 2A represents a detail of the outboard ring structure shown in FIG. 1A, but drawn to a larger scale. Due to the larger scale, it can be seen that end cap 36 is provided with a shallow recess 43 just to the right of the guide surface 44. The trough of this recess 43 provides a predetermined starting position for the thread when it rests on the end cap 36 prior to movement into the catching ring. In the starting position the thread lies in a plane normal to the chuck axis 12 (FIG. 1A) as indicated by the dotted line 52 extending through the trough of recess 43 in FIG. 2A. It will be recalled that in this starting condition the thread extends from the friction drive roller 50 (FIG. 3) over the end cap 36 to the outgoing package into which it is still being wound because of the rotational inertia of that package which has not yet been braked to a standstill.

When thread guide bar 60 begins to move axially of chuck 10 the thread will move out of the plane at right angles to the chuck axis 12 and will begin to slide on the end cap 36 to adopt an angle $\alpha$ (FIG. 2B) with respect to the plane through the trough of recess 43. Angle $\alpha$ is dependent upon the speed of axial movement of the corresponding notch 62 in thread guide bar 60. As will be explained further below, FIG. 2B has been grossly simplified for purposes of illustration of the principles only. According to these principles, thread guide bar 60 is moved with a constant axial speed throughout the phase A (FIG. 2B) during which the thread is moved into the clamp provided between one of the clamping pins 45 and the corresponding tooth 42. For the present, the corresponding angle $\alpha$ can be assumed to be correspondingly constant.

As soon as the thread has been caught by the clamp 45, 42, the speed of the thread guide bar 60 is increased to a higher level which is maintained constant throughout the phase B (FIG. 2B) while the thread is moved from the clamping point onto the bobbin tube 26. The corresponding winding angle is indicated at $\beta$ in FIG. 2B, and it is an essential feature of this invention that angle $\beta$ is greater than angle $\alpha$.

Figure 2B:
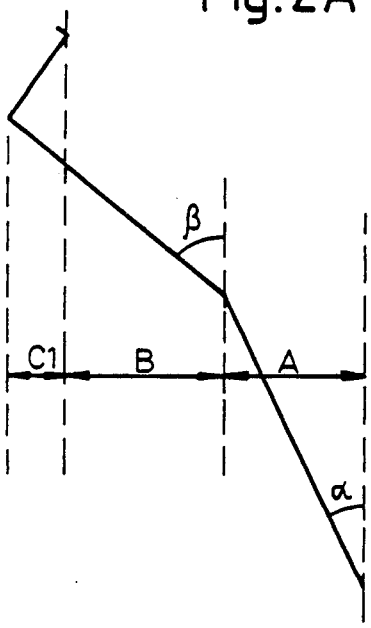
FIG. 2B is a representation of the "winding angle" of a thread relative to the illustrated chuck portion during a changeover operation.

In the phase C1 to C3 (FIG. 2C) only partially illustrated as phase C1 in FIG. 2B, a transfer tail winding is formed on the bobbin tube 26. Thereafter, the thread passes into the traverse region in which the main package structure is built up. Phase C1 to C3 will not be described in any significant detail in this specification, since the principles involved have already been adequately explained in the aforementioned U.S. Pat. No. 3,920,193, to which reference may be readily had and the disclosure of which is incorporated herein by reference. However, in relation to the illustrated portion C1 of phase C1 to C3, some further description will be provided in conjunction with the description of FIGS. 4A and 4B, since the piston and cylinder unit illustrated in such figures provides a convenient and elegant means of obtaining the effect represented in FIG. 2B. For the present, the description will concentrate upon phases A and B which represent the primary developments in accordance with this invention.

In interpreting FIG. 2B, it must be borne in mind that the diagram does not represent the thread itself but only an approximated winding angle of the thread relative to a plane normal to the chuck axis. In FIG. 2B, the relevant angles have been grossly exaggerated for ease of illustration of the principles involved. These angles are in any event not directly observable and must be derived by calculations involving approximations as further explained below.

Angle $\alpha$ must be maintained below a certain maximum value dependent upon the design of the thread catching ring structure. If this maximum value is exceeded, there is a risk that the thread will bridge the ring structure and will not be caught, so that the changeover operation is a failure. In practical terms, this means that there is a certain maximum permissible speed for the axial movement of the thread guide bar 60 during the phase A.

During this phase A, thread guide bar 60 is functioning in the same way as a traverse mechanism and the winding angle $\alpha$ can be assessed in the same way as the winding angle induced by a traverse mechanism, i.e. by reference to the relation between the speed of the traverse guide notch 62 axially of the chuck 10 and the linear speed of the thread delivered to the package. Based on this calculation, an angle $\alpha$ of up to about 1° is normally permissible, but the preferred range for angle $\alpha$ is 0.5° to 0.8°.

The requirements for angle $\beta$ are the opposite of those for angle $\alpha$. With a steeper angle $\beta$ the thread presents a better profile to the catching means usually provided on the bobbin tube end, e.g. in the form of a notch in that tube end. Angle $\beta$ is preferably made as high as possible, the practical limit being determined by the practical possibilities of accelerating the masses associated with the movement of the thread guide bar 60. A minimum angle $\beta$ of 2° is desirable, and the preferred range for angle $\beta$ with the currently available means for moving the thread guide bar 60 lies above 3°.

The winding angle in the transfer tail phase C1 to C3 as the thread passes into the package traverse zone is similar to the angle $\beta$. In FIG. 2B an over-wound thread reserve is produced in the phase C1 to C3 by reversing the direction of winding in this phase, thereby fixing the thread tail released by the clamp 45, 42 at the completion of the winding operation.

FIG. 2C represents an oscillograph trace T illustrating the movement of the thread guide bar 60 in a winder according to the invention. The horizontal axis of this diagram represents distance travelled along the chuck axis by one of the notches 62 in the thread guide bar 60 and the vertical axis represents time. The scale of the horizontal axis of this trace is different from that of FIG. 2B, but the phases of movement of the thread guide bar 60 corresponding to phases A, B and C1 to C3 of FIG. 2B are clearly recognizable.

Phase A is the time during which the thread 52 is being moved into the clamp 45, 42. Phase B is the time during which the thread 52 is being moved from the clamp 45, 42 onto the bobbin tube 26, 34. Phase C1 to C3 is subdivided into phases C1, C2 and C3 in FIG. 2C and only phase C1 is illustrated in FIG. 2B. During phase C1, the thread reserve is formed. The transfer from phase A to phase B is not a precise instant but occurs in the region of the knee K of the trace T. Thus transition location P is not a precisely located point but rather a region of the curve represented by the trace T. Phase C1 to C3 has been divided into three intervals C1, C2 and C3. These intervals respectively represent the formation of an overwrapped reserve or tail, a short dwell time and movement into the package winding zone.

As would be expected, it is not possible to achieve absolutely constant velocity within the various phases and sudden changes of velocity between phases. Over the phase A, beginning at the origin O of the curve T and leading towards the knee K in the curve T, the average velocity is approximately 0.16 m/sec.; with a delivered speed of the thread of 3000 m/min., this gives a calculated angle $\alpha$ of 0.18°.

The speed represented by a tangent at the knee in the curve is 0.42 m/sec., giving a calculated angle of 0.48° at the transition location P between the phases A and B. The average speed in phase B has been measured in the range 0.5 to 2.5 m/sec., giving an angle $\beta$ of 1.7° to 2.8°, again calculated at a delivered linear thread speed of 3000 m/min. Using this system it has been possible to reduce the percentage of rejected thread reserves or transfer tails, due to failure of the thread to climb onto the bobbin tube.

Figure 3A:
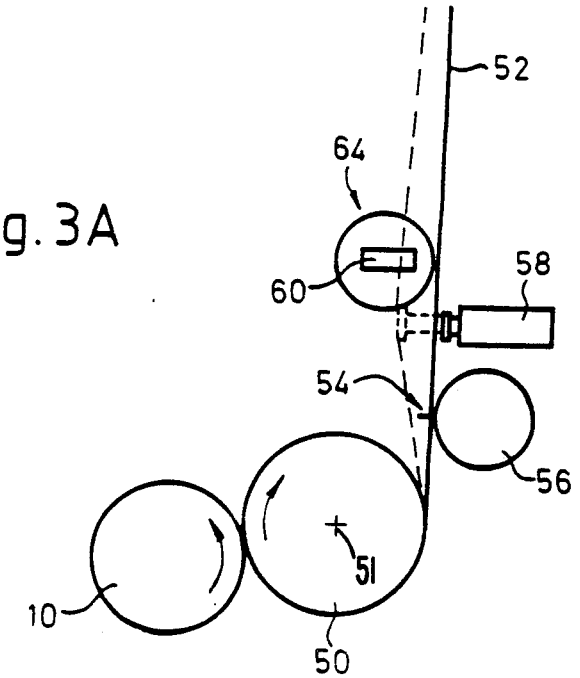
FIG. 3A is a diagrammatic representation of a portion of a winding machine including a chuck structure in accordance with FIG. 1.
Figure 3B:
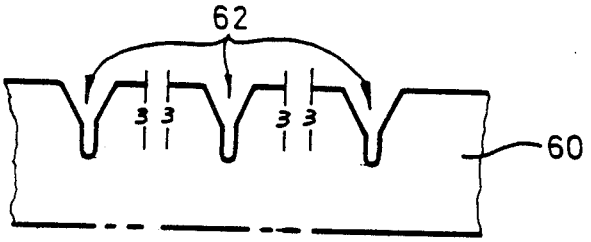
FIG. 3B shows a detail of FIG. 3 drawn to a larger scale.
Figure 4C:
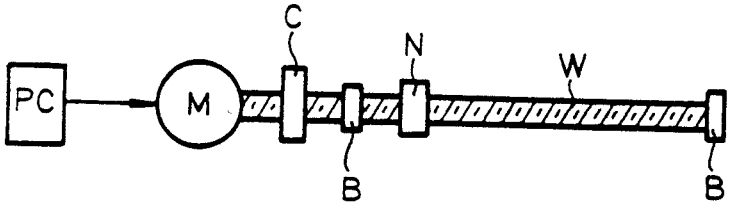
FIG. 4C is a diagram of an alternative drive means.

FIGS. 4A and 4B illustrate a pneumatically operated piston and cylinder unit suitable for use as unit 64 in the arrangement illustrated diagrammatically in FIG. 3A. FIG. 4A represents the left hand portion of the piston and cylinder unit and FIG. 4B represents the right hand portion of the same piston and cylinder unit, the portions being joined at the line I—I in these figures. The portions can be considered separately, since they perform quite separate functions. Their common chamber 66 is used as a common pressure reservoir for both portions. The left hand portion (64A, FIG. 4A) of unit 64 controls and operates the thread guide bar 60 during the phases A and B, and this portion will be described first. Portion 64A comprises the common pressure reservoir chamber 66, defined by cylinder portion 68, and an auxiliary chamber 70 within cylinder portion 72. Cylinder portions 68 and 72 are joined by a bulkhead or dividing structure 74 having a central opening 76. When central opening 76 is closed, as will be described below, the bulkhead 74 and the closure for opening 76 together isolate auxiliary chamber 70 from common pressure reservoir chamber 66. As soon as the closure is removed from the central opening 76, the auxiliary chamber 70 is subjected to the pressure in common pressure reservoir chamber 66.

Auxiliary chamber 70 contains a piston 78 having a piston rod 80 extending through an end block 82 defining the left hand end of auxiliary chamber 70 and the left hand end of unit 64. The piston rod 80, which defines a movable thread guide carrier, is operatively connected with the thread guide bar 60. The unit 64 is illustrated in the starting condition, in which the thread passes through the plane of the recess 43 (FIG. 2A) and lies in the plane normal to the chuck axis 12. In this condition, piston 78 engages bulkhead 74. In this condition, an extension 84 formed integrally with piston 78 projects through the opening 76 into common pressure reservoir chamber 66. A seal 86 provided in the bulkhead 74 engages extension 84 so that the latter forms an effective closure for the central opening 76 as referred to above.

Common pressure reservoir chamber 66 can be pressurized and vented via an opening 88 (FIG. 4B) in cylinder portion 68. Auxiliary chamber 70 can be pressurized and vented via the passages 90, 92 formed in end block or plug 82 (FIG. 4A). These passages 90, 92 are joined by an auxiliary chamber 94 containing a valve element 96, preferably a rapid-vent valve. When the passage 90 is pressurized, valve element 96 is forced to the upper end of chamber 94 (as viewed in FIG. 4A), and the pressure applied to passage 90 is communicated via chamber 94 and passage 92 to the chamber 70. If chamber 66 is vented at this stage, piston 78 is forced into the illustrated condition engaging bulkhead 74.

If sub-atmospheric pressure appears at passage 90, valve element 96 is drawn rapidly downwardly (as viewed in FIG. 4A) along auxiliary chamber 94 into the illustrated condition or state, in which the upper portion of chamber 94, passage 92 and the auxiliary chamber 70 are vented directly to the atmosphere. This venting effect is produced in order to start the leftward movement of thread as viewed in FIG. 2B. Before this triggering operation, the vent in end block 82 is held closed and the auxiliary chamber 70 is pressurized. Common pressure reservoir chamber 66 is also pressurized, but since the pressure in this chamber 66 acts only on the surface area presented by the axial face of the extension 84, it is relatively easy for the pressure in auxiliary chamber 70, acting upon the full axial face of the piston 78, to hold this piston 78 against the bulkhead 74 until vent valve 96 is opened.

When valve 96 is opened, the force produced by the pressure in common pressure reservoir chamber 66 urges piston 78 towards the left in auxiliary chamber 70 at a speed dependent upon the pressure in chamber 66 and the effective surface area of the extension 84. This represents phase A. Auxiliary chamber 70 remains isolated from the pressure in common pressure reservoir chamber 66 until the extension 84 clears the bulkhead 74 and frees the central opening 76 for communication of fluid pressure between these chambers 66 and 70. Piston 78 is then subjected to the full pressure available in reservoir or common pressure reservoir chamber 66 on the full cross-sectional area of cylinder portion or auxiliary chamber 70. The movement of piston 78 towards the left is accelerated very rapidly and piston 78 is driven against the end block or plug 82 defining the left hand end of auxiliary chamber 70. This represents phase B referred to above and extends into phase C1 as seen in FIG. 2B. The recoil from this substantial blow produces the return movement indicated in the illustrated portion of phase C1.

A ring 98 of resiliently compressible material is secured on the end block or plug 82 within the auxiliary chamber 70 surrounding the piston rod 80. This acts as a shock absorber for absorbing some of the impact of the piston 78 on the end block or plug 82. The resilience of the material of ring 98 is such that this ring 98 can force piston 78 back against the pressure provided from reservoir or common pressure reservoir chamber 66 after the initial impact has been absorbed. This assists the recoil or return movement referred to above and thus helps to produce the overwound transfer tail referred to above. As can be seen on the oscillograph trace of FIG. 2C, by adaptation of the characteristic of the material of ring 98, a degree of oscillation can be induced in phase C1 to C3 so that a double overwinding is induced.

FIG. 4B illustrates an arrangement very similar in principle to that shown in FIG. 4A, and it is believed that a very brief description of this arrangement will suffice. In FIG. 4B, auxiliary chamber 200 corresponds to auxiliary chamber 70 in FIG. 4A; bulkhead 202 corresponds to bulkhead 74; piston 204 and piston rod 206 correspond to piston 78 and piston rod 80, respectively; extension 208 corresponds to extension 84 and block or plug 210 corresponds to plug 82. This arrangement produces the phase or interval C3 of movement in the package winding zone shown in FIG. 2C; the extension 208 can therefore be made substantially shorter than the extension 84, since it is not required to produce a long phase, similar to the phase A, as an introduction to the interval C3. The short extension 208 serves merely to seal with the bulkhead 202.

The invention is not limited to details of the embodiment illustrated in and described with reference to the drawings. In particular, the arrangement shown in FIG. 3A has been given by way of example only, to show the complete application of the principles to a specific winding machine. However, it is not necessary that the change in thread movement proposed by this invention be induced by a thread guide system such as that shown in FIG. 3A.

Although the invention is expected to have its most useful application in automatic winders enabling wasteless operation, the simple diagrammatical illustration in FIG. 3A indicates that this also is not an essential feature. The invention can equally be applied to winders having only a single chuck where an interruption of winding is essential between successive winding operations in order to enable removal of the completed packages from the single chuck and substitution of fresh bobbin tubes therefor.

Furthermore, the invention is not limited to the friction drive system shown in FIG. 3A: alternative drive systems in which the chuck is driven directly by its own drive motor are well known in the winding art and the invention is equally applicable to them.

Where a friction drive system is used, it is not essential to use the so-called print friction arrangement shown in FIG. 3A in which the thread is passed around the friction drive roller 50 before being transferred to the package. Alternative systems in which the thread is transferred to the package without first contacting the friction drive roller are known and the invention is applicable to them.

Also shown in FIG. 1B is a conventional device generally indicated at 100 for positioning or locating the bobbin tube 26 at a predetermined location on the chuck 10. Since this positioning device 100 is of a generally known type, it has not been illustrated in detail, and will not be described in detail. Generally, the positioning or locating device 100 comprises a short lever 101 having a head portion 102 and a stop portion 104. The lever 101 is formed as a rocker which is pivoted by a not particularly shown conventional compression spring extending between the lever 101 and a recess 106 in the external surface of the hollow tube 14. The compression spring causes the head portion 102 to project radially outwardly from the body 108 of the device and hence radially outwardly from the external surface of sleeve 18. Stop portion 104 is therefore held within the body 108.

The body 108 is mounted in the ring structure 40, 46. When the bobbin tube 34 is fitted onto the chuck 10, the inboard end of this bobbin tube 34 rides over the head portion 102 forcing that portion 102 downwardly into the body 108. So long as the bobbin tube 34 is located over the body 108, stop portion 104 is also maintained within the body 108. However, as soon as the outboard end of bobbin tube 34 passes over the stop portion 104, the compression spring forces the stop portion 104 outwardly. The outboard end of the bobbin tube 34 is located over the head portion 102, retaining it within the body 108, so that stop portion 104 is maintained as a projection from the outer surface of the body 108. Bobbin tube 26 can be located against this stop portion 104. If more than two packages are to be formed, then a similar positioning or locating device 100 can be used to locate the bobbin tube 34 and/or any other bobbin tube on the chuck 10. Alternative positioning or locating systems are, however, well known in the art and the illustrated type is not essential to this invention.

The time intervals represented by phases A and B in FIG. 2B, and the related speeds of movement represented by the oscillograph trace T of FIG. 2C, can be controlled within limits by selection of the length and cross-sectional area of the extension 84, the pressure in reservoir or common pressure reservoir chamber 66, the cross-sectional area of auxiliary chamber 70 and the length of that chamber 70. Final setting of the system to produce the optimum effect can be obtained by adjusting the position of the unit 64 at the mountings (not shown) securing it to the machine.

It is not essential to eliminate entirely windings formed on the chuck 10 (as opposed to the bobbin tube). A relatively short tail formed of such loosened windings, for example of approximately the same axial length as the bobbin tube itself, generally produces no problems. Attempts to eliminate such short tails will usually simply lead to unduly costly measures in controlling the system.

The invention is not limited to use with a chuck in whch the thread catching and cutting structure is permanently recessed below the outer peripheral surface of the chuck. Chucks have already been proposed in which catching and cutting devices are mounted for radial movement relative to the chuck between radially inner positions (when the chuck is stationary and a doffing operation is carried out) and radially outer positions (when the chuck is rotating and a changeover operation is to be effected), cf. U.S. Pat. No. 4,155,512, granted May 22, 1979.

The present invention also has advantages when applied to such a system. Rapid transfer from the catching and cutting device to the bobbin tube reduces the risk of formation of windings on the catching and cutting elements. In the case of moveable catching and cutting devices, such windings could cause severe operating disturbances.

The piston and cylinder moving means could be replaced by alternative systems, for example cam devices operated by a suitable cam shaft. In a still further alternative, the thread guide element or bar 60 shown in FIG. 3A could be reciprocatable by a stepping motor M shown in FIG. 4C, for example by means of a worm gear W and nut linkage N for converting the rotary output of the stepping motor to a reciprocating drive for the thread guide bar 60. Such a stepping motor M could be controlled by a programmable controller PC also shown in FIG. 4C to enable ready adjustment of operating characteristics to actual requirements. A clutch C is preferably provided between the drive or stepping moor M and the worm gear W and the latter can be supported in bearing elements B.

The thread guide element or bar 60 illustrated in FIG. 3A has been designed to move all threads of a given winding position simultaneously. This is not essential.

For example, where settings are extremely critical, it may be desirable to provide individual guides for each of the threads at the position.

While there are shown and described present preferred embodiments of the invention, it is to be distinctly understood that the invention is not limited thereto, but may be otherwise variously embodied and practiced within the scope of the following claims.

Accordingly, what we claim is:

1. A method of forming an overwound thread transfer tail, comprising the steps of:

winding thread onto a bobbin tube to form a thread package;

providing an empty bobbin tube at which there is to be formed an overwound thread transfer tail;

engaging the thread which is being wound on the thread package by a thread guide supported on a movable thread guide carrier;

moving the movable thread guide carrier supporting the thread guide engaging the thread in a first direction towards an abutment while continuing to wind thread onto the thread package;

continuing movement of the movable thread guide carrier which supports the thread guide engaging the thread in said first direction such that the abutment causes said thread guide carrier to recoil and to undertake a return movement of the thread guide engaging the thread which is being wound on the thread package and which return movement is in a direction opposite to said first direction; and then moving said movable thread guide carrier and the thread guide engaging the thread back in said first direction to thereby form an overwound thread transfer tail.

2. An apparatus for forming an overwound thread transfer tail, comprising:

means for supporting and rotating a thread package;

traverse means for traversing the thread over a predeterminate traverse zone;

a thread guide;

a movable member movable in a first predetermined direction and connected to said thread guide;

an abutment for limiting movement of said movable member in said first predetermined direction;

means for eliminating the action of the traverse means for traversing the thread over said predeterminate traverse zone and for engaging the thread with said thread guide;

means for moving said movable member in said first predetermined direction towards said abutment such that said movable member and said thread guide are caused to recoil in a direction opposite to said first predetermined direction by virtue of the effect of the abutment upon said movable member and said thread guide; and said means for moving said movable member and said thread guide serving to continue to move said movable member and said thread guide back in said first predetermined direction following said recoil.

3. The apparatus as defined in claim 2, further including:

a resilient damping means positioned to act upon said movable member; and said abutment supporting said resilient damping means.

4. A method of forming an overwound thread transfer tail, comprising the steps of:

providing an empty bobbin tube at which there is to be formed an overwound thread transfer tail;

rotating the empty bobbin tube;

engaging a thread which is to be wound on the empty bobbin tube by a thread guide supported on a movable thread guide carrier;

moving the movable thread guide carrier supporting the thread guide engaging the thread in a first direction towards an abutment while winding thread onto the empty bobbin tube;

continuing movement of the movable thread guide carrier which supports the thread guide engaging the thread in said first direction such that the abutment causes said thread guide carrier to recoil and to undertake a return movement of the thread guide engaging the thread which is being wound on the empty bobbin tube and which return movement is in a direction opposite to said first direction; and then moving said movable thread guide carrier and the thread guide engaging the thread back in said first direction to thereby form an overwound thread transfer tail on the empty bobbin tube.

* * * * *